US009107266B2

(12) United States Patent
Wang et al.

(10) Patent No.: US 9,107,266 B2
(45) Date of Patent: Aug. 11, 2015

(54) LIGHTING APPARATUS HAVING HIGH OPERATION RELIABILITY AND LIGHTING SYSTEM USING THE SAME

(75) Inventors: Ching-Hung Wang, Hsin-Chu (TW); Sheng-Kai Hsu, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 939 days.

(21) Appl. No.: 13/208,354

(22) Filed: Aug. 12, 2011

(65) Prior Publication Data

US 2012/0229035 A1 Sep. 13, 2012

(30) Foreign Application Priority Data

Mar. 9, 2011 (TW) ..... 100107886 A

(51) Int. Cl.
*H05B 33/08* (2006.01)

(52) U.S. Cl.
CPC ..... *H05B 33/0845* (2013.01); *H05B 33/0806* (2013.01)

(58) Field of Classification Search
None
See application file for complete search history.

(56) References Cited

U.S. PATENT DOCUMENTS 7,579,786 B2 8/2009 Soos

FOREIGN PATENT DOCUMENTS

| | | | | |
|---|---|---|---|---|
| CN | 101059931 A | | 10/2007 | |
| JP | 2000150963 A | * | 5/2000 | ..... H01L 33/00 |
| TW | 200901429 | | 1/2009 | |
| TW | 201036487 | | 10/2010 | |

* cited by examiner

*Primary Examiner* — Douglas W Owens
*Assistant Examiner* — Dedei K Hammond
(74) *Attorney, Agent, or Firm* — Winston Hsu; Scott Margo

(57) ABSTRACT

A lighting apparatus having high operation reliability includes a first lighting unit with a first turn-on voltage and a second lighting unit with a second turn-on voltage greater than the first turn-on voltage. The lighting apparatus is put in use for generating output light according to a driving current flowing through the first lighting unit or the second lighting unit. The first lighting unit is capable of generating output light having a first brightness according to the driving current. The second lighting unit, electrically connected in parallel with the first lighting unit, is capable of generating output light having a second brightness according to the driving current. The second brightness is preferably identical to the first brightness.

8 Claims, 5 Drawing Sheets

LIGHTING APPARATUS HAVING HIGH OPERATION RELIABILITY AND LIGHTING SYSTEM USING THE SAME

BACKGROUND

1. Technical Field

The description relates to a lighting apparatus, and more particularly, to a lighting apparatus having high operation reliability and related lighting system using the same.

2. Description of the Related Art

Light emitting diodes (LEDs) have advantages of lightweight, small size, low power consumption and high-bright lighting capability, and are broadly adopted for use in a variety of indication applications, indoor or outdoor lighting applications, vehicle auxiliary lighting applications, camera flashlights, and so forth. Besides, the backlight sources of liquid crystal displays are switched from traditional cold cathode fluorescent lamps (CCFLs) or external electrode fluorescent lamps (EEFLs) to LED lighting apparatuses gradually. In general, the lighting apparatus of an LED lighting system is formed by plural LEDs connected in series. In view of that, if one of the LEDs is broken off due to a burned-out event, other LEDs serially connected with the broken LED are unable to work accordingly. That is, the lighting operation of prior-art LED lighting system is hard to reach high reliability.

SUMMARY

In accordance with an embodiment, alighting apparatus having high operation reliability is provided. The lighting apparatus comprises a first lighting unit with a first turn-on voltage and a second lighting unit with a second turn-on voltage greater than the first turn-on voltage. The second brightness is preferably identical to the first brightness. In the operation of the lighting apparatus, when the first lighting unit functions properly, the driving current is flowing through the first lighting unit so as to perform a lighting operation, and the second lighting unit is idled. Alternatively, when the first lighting unit is broken off, the driving current is flowing through the second lighting unit so as to continue performing the lighting operation.

In accordance with the embodiment, a lighting system having high operation reliability is further provided. The lighting system comprises a driving voltage providing circuit for providing a driving voltage, a first lighting unit with a first turn-on voltage, a second lighting unit with a second turn-on voltage greater than the first turn-on voltage, and a driving current control circuit electrically connected to the first and second lighting units. The second turn-on voltage is less than the driving voltage. The first lighting unit, electrically connected to the driving voltage providing circuit for receiving the driving voltage, is utilized for generating output light having a first brightness according to a driving current. The second lighting unit, electrically connected in parallel with the first lighting unit and electrically connected to the driving voltage providing circuit for receiving the driving voltage, is utilized for generating output light having a second brightness according to the driving current. The second brightness is preferably identical to the first brightness. The driving current control circuit is employed to control the driving current flowing through the first lighting unit or the second lighting unit.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the present invention will be described in detail with reference to the accompanying drawings. Here, it is to be noted that the present invention is not limited thereto.

Figure 1:
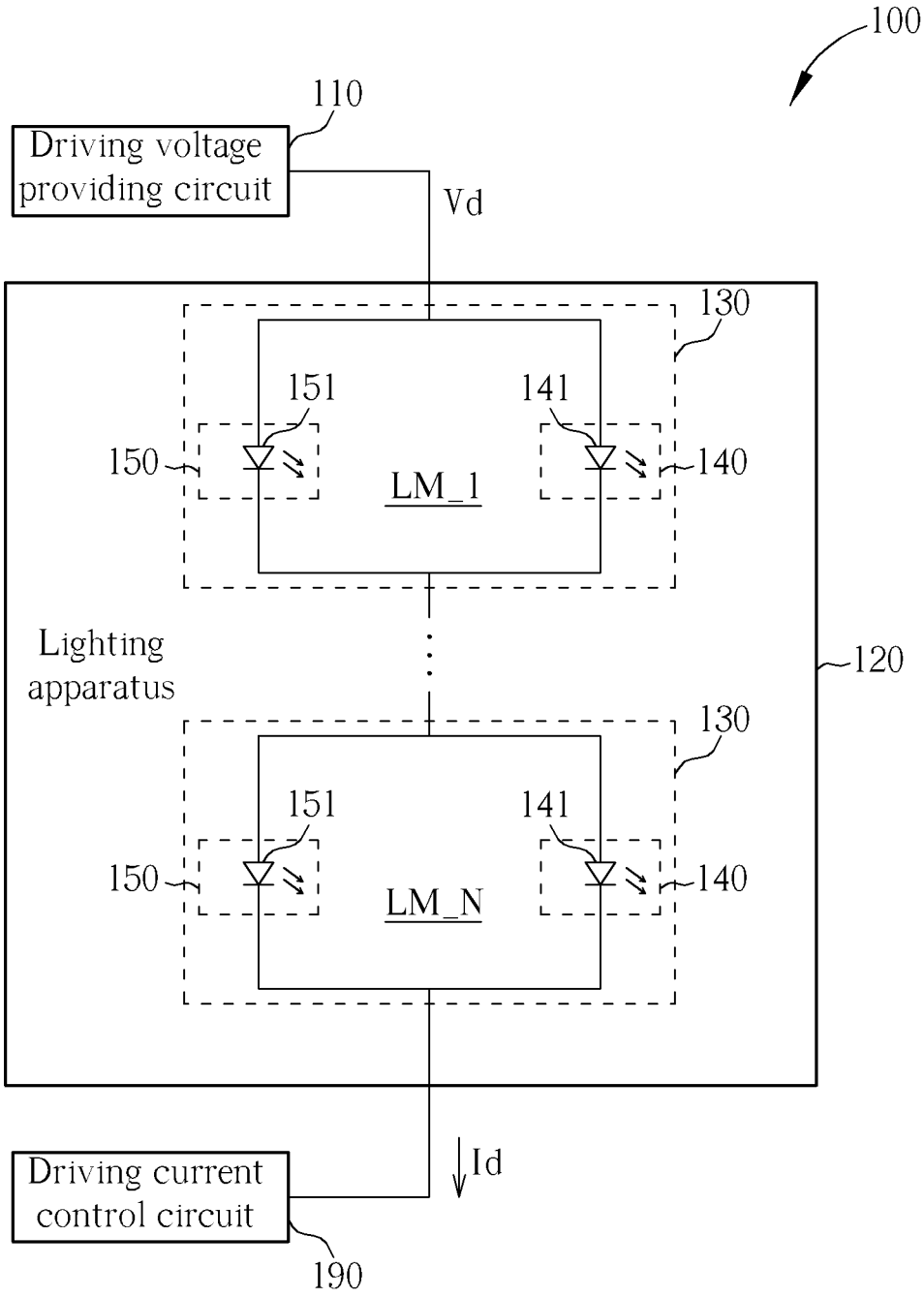
FIG. 1 is a schematic diagram showing a lighting system in accordance with a first embodiment.

FIG. 1 is a schematic diagram showing a lighting system in accordance with a first embodiment. As shown in FIG. 1, the lighting system 100 comprises a driving voltage providing circuit 110, a driving current control circuit 190, and a lighting apparatus 120 electrically connected between the driving voltage providing circuit 110 and the driving current control circuit 190. The driving voltage providing circuit 110 is employed to provide a driving voltage Vd. The driving current control circuit 190 is employed to control a driving current Id flowing through the lighting apparatus 120. The lighting apparatus 120 includes a plurality of lighting modules 130 electrically connected in series. Each of the lighting modules 130 comprises a first lighting unit 140 with a first turn-on voltage and a second lighting unit 150 with a second turn-on voltage greater than the first turn-on voltage. The second lighting unit 150 is electrically connected in parallel with the first lighting unit 140. The sum of the second turn-on voltages of the second lighting units 150 in the lighting apparatus 120 is less than the driving voltage Vd. In one embodiment, the first lighting unit 140 and the second lighting unit 150 of each lighting module 130 are both disposed in one and the same chip, i.e. the lighting apparatus 120 includes at least one chip. In another embodiment, the lighting modules 130 of the lighting apparatus 120 are all disposed in one and the same chip. It is noted that the first turn-on voltage is the voltage drop across the first lighting unit 140 when the driving current Id flows through the first lighting unit 140, and the second turn-on voltage is the voltage drop across the second lighting unit 150 when the driving current Id flows through the second lighting unit 150. In view of that, when the first lighting unit 140 of one lighting module 130 is functioning properly, the voltage drop across the second lighting unit 150 of the same lighting module 130 is the first turn-on voltage less than the second turn-on voltage, and therefore the second lighting unit 150 is idled at this time.

The first lighting unit 140 is capable of generating output light having a first brightness according to the driving current Id. The second lighting unit 150 is capable of generating output light having a second brightness according to the driving current Id. The second brightness is preferably identical to the first brightness. In the embodiment shown in FIG. 1, the first lighting unit 140 comprises a first LED 141 with a first lighting operation voltage, and the second lighting unit 150 comprises a second LED 151 with a second lighting operation voltage. The first lighting operation voltage is identical to the first turn-on voltage, and the second lighting operation voltage is identical to the second turn-on voltage. When the driving current Id flows through the first LED 141 of one first lighting unit 140, the first LED 141 generates output light having the first brightness. When the driving current Id flows through the second LED 151 of one second lighting unit 150, the second LED 151 generates output light having the second brightness.

In the operation of the lighting system 100, if the first LEDs 141 of the lighting modules 130 are all functioning properly, the conduction path of the lighting apparatus 120 is formed by the first LEDs 141. That is, the driving current Id is flowing through all the first LEDs 141 for providing desired output light, and the second LEDs 151 of the lighting modules 130 in the lighting apparatus 120 are all idled. If the first LED 141 of the lighting module LM_1 is broken off, the conduction path of the lighting apparatus 120 is formed by the second LED 151 of the lighting module LM_1 and the first LEDs 141 of other lighting modules 130, and therefore the driving current Id flows through the second LED 151 of the lighting module LM_1 and the first LEDs 141 of other lighting modules 130. Alternatively, if the first LED 141 of the lighting module LM_N is broken off, the conduction path of the lighting apparatus 120 is formed by the second LED 151 of the lighting module LM_N and the first LEDs 141 of other lighting modules 130, and therefore the driving current Id flows through the second LED 151 of the lighting module LM_N and the first LEDs 141 of other lighting modules 130. Besides, if the second brightness is substantially identical to the first brightness, the lighting apparatus 120 is capable of providing output light having the same brightness regardless of which conduction path is formed therein. In summary, the lighting system 100 is able to perform a lighting operation with high reliability.

Figure 2:
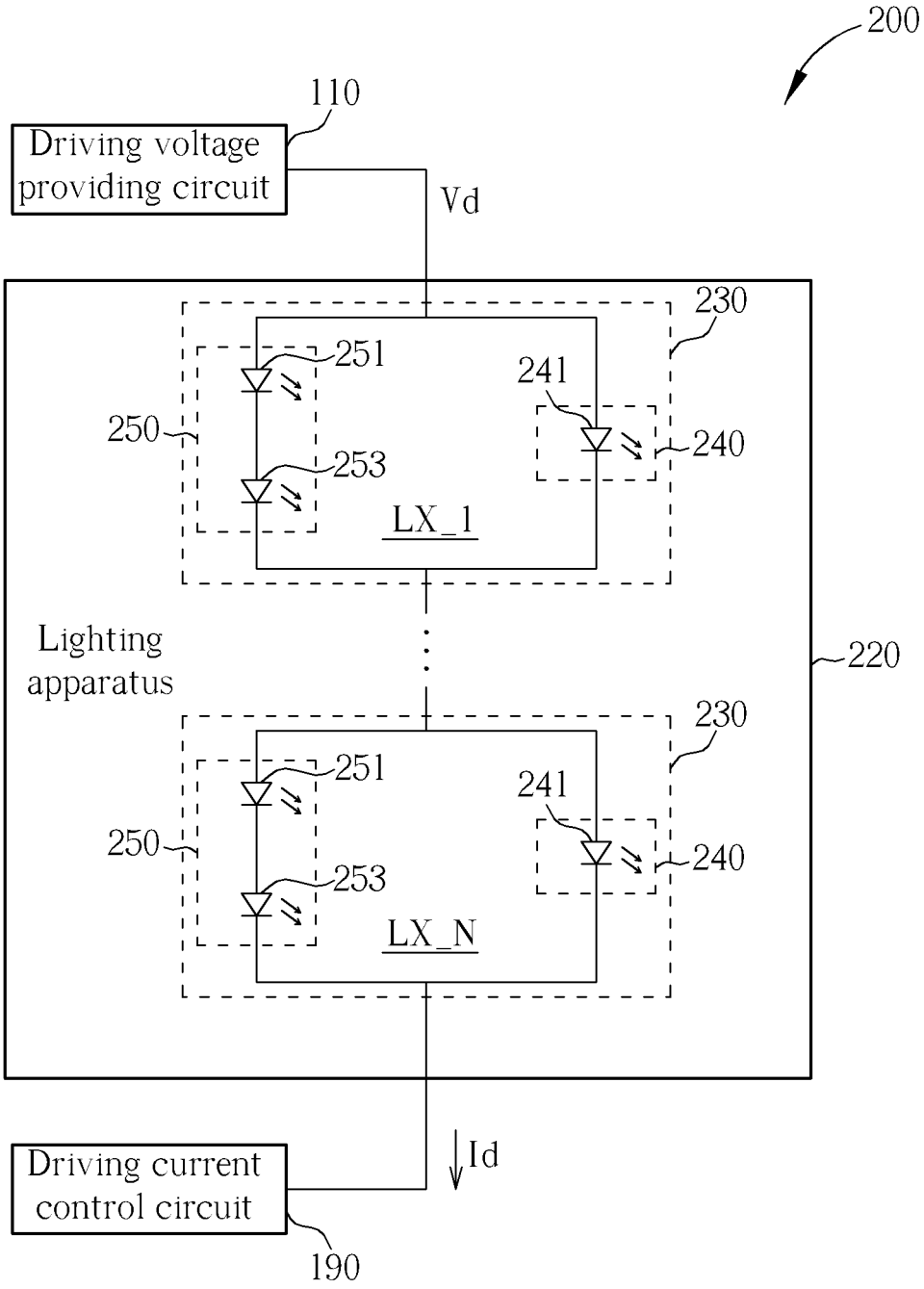
FIG. 2 is a schematic diagram showing a lighting system in accordance with a second embodiment.

FIG. 2 is a schematic diagram showing a lighting system in accordance with a second embodiment. As shown in FIG. 2, the lighting system 200 comprises the driving voltage providing circuit 110, the driving current control circuit 190, and a lighting apparatus 220 electrically connected between the driving voltage providing circuit 110 and the driving current control circuit 190. The lighting apparatus 220 includes a plurality of lighting modules 230 electrically connected in series. Each of the lighting modules 230 comprises a first lighting unit 240 with a first turn-on voltage and a second lighting unit 250 with a second turn-on voltage greater than the first turn-on voltage. The second lighting unit 250 is electrically connected in parallel with the first lighting unit 240. The sum of the second turn-on voltages of the second lighting units 250 in the lighting apparatus 220 is less than the driving voltage Vd. In one embodiment, the first lighting unit 240 and the second lighting unit 250 of each lighting module 230 are both disposed in one and the same chip. In another embodiment, the lighting modules 230 of the lighting apparatus 220 are all disposed in one and the same chip. It is noted that the first turn-on voltage is the voltage drop across the first lighting unit 240 when the driving current Id flows through the first lighting unit 240, and the second turn-on voltage is the voltage drop across the second lighting unit 250 when the driving current Id flows through the second lighting unit 250. In view of that, when the first lighting unit 240 of one lighting module 230 is functioning properly, the voltage drop across the second lighting unit 250 of the same lighting module 230 is the first turn-on voltage less than the second turn-on voltage, and therefore the second lighting unit 250 is idled at this time.

The first lighting unit 240 is capable of generating output light having a first brightness according to the driving current Id. The second lighting unit 250 is capable of generating output light having a second brightness according to the driving current Id. The second brightness is preferably identical to the first brightness. In the embodiment shown in FIG. 2, the first lighting unit 240 comprises a first LED 241 with a first lighting operation voltage, and the second lighting unit 250 comprises a second LED 251 with a second lighting operation voltage and a third LED 253 with a third lighting operation voltage. The third LED 253 is electrically connected in series with the second LED 251. The third lighting operation voltage may be identical to or different from the second lighting operation voltage. The first lighting operation voltage is identical to the first turn-on voltage, and the sum of the second and third lighting operation voltages is identical to the second turn-on voltage. When the driving current Id flows through the first LED 241 of one first lighting unit 240, the first LED 241 generates output light having the first brightness. When the driving current Id flows through the second LED 251 and the third LED 253 of one second lighting unit 250, the brightness of combination output light generated by the second LED 251 and the third LED 253 is identical to the second brightness.

In the operation of the lighting system 200, if the first lighting units 240 of the lighting modules 230 are all functioning properly, the conduction path of the lighting apparatus 220 is formed by the first lighting units 240. That is, the driving current Id is flowing through all the first lighting units 240 for providing desired output light, and the second lighting units 250 of the lighting modules 230 in the lighting apparatus 220 are all idled. If the first lighting unit 240 of the lighting module LX_1 is broken off, the conduction path of the lighting apparatus 220 is formed by the second lighting unit 250 of the lighting module LX_1 and the first lighting units 240 of other lighting modules 230, and therefore the driving current Id flows through the second lighting unit 250 of the lighting module LX_1 and the first lighting units 240 of other lighting modules 230. Alternatively, if the first lighting unit 240 of the lighting module LX_N is broken off, the conduction path of the lighting apparatus 220 is formed by the second lighting unit 250 of the lighting module LX_N and the first lighting units 240 of other lighting modules 230, and therefore the driving current Id flows through the second lighting unit 250 of the lighting module LX_N and the first lighting units 240 of other lighting modules 230. Besides, if the second brightness is substantially identical to the first brightness, the lighting apparatus 220 is capable of providing output light having the same brightness regardless of which conduction path is formed therein. In summary, the lighting system 200 is able to perform a lighting operation with high reliability.

Figure 3:
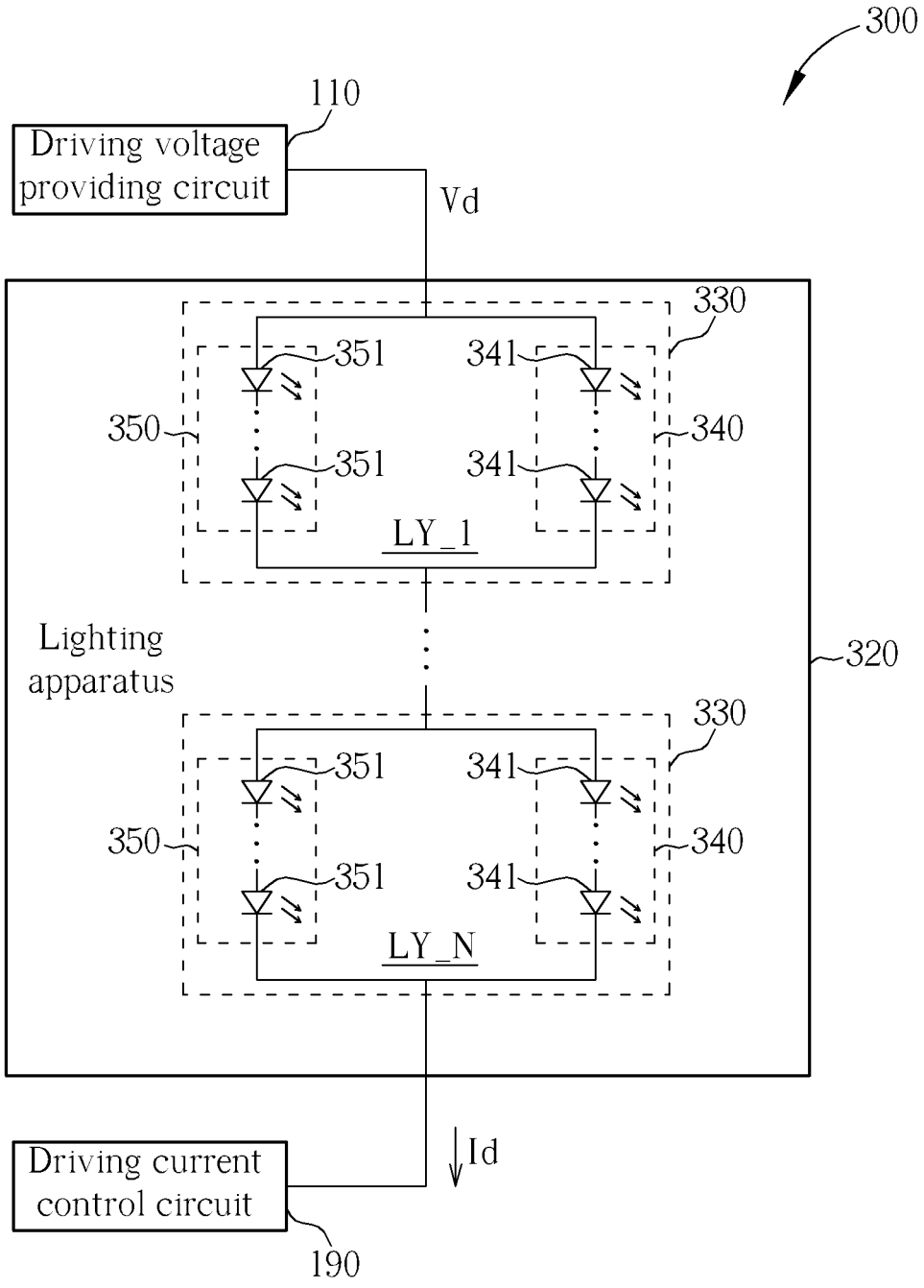
FIG. 3 is a schematic diagram showing a lighting system in accordance with a third embodiment.

FIG. 3 is a schematic diagram showing a lighting system in accordance with a third embodiment. As shown in FIG. 3, the lighting system 300 comprises the driving voltage providing circuit 110, the driving current control circuit 190, and a lighting apparatus 320 electrically connected between the driving voltage providing circuit 110 and the driving current control circuit 190. The lighting apparatus 320 includes a plurality of lighting modules 330 electrically connected in series. Each of the lighting modules 330 comprises a first lighting unit 340 with a first turn-on voltage and a second lighting unit 350 with a second turn-on voltage greater than the first turn-on voltage. The second lighting unit 350 is electrically connected in parallel with the first lighting unit 340. The sum of the second turn-on voltages of the second lighting units 350 in the lighting apparatus 320 is less than the driving voltage Vd. In one embodiment, the first lighting unit 340 and the second lighting unit 350 of each lighting module 330 are both disposed in one and the same chip. In another embodiment, the lighting modules 330 of the lighting apparatus 320 are all disposed in one and the same chip. It is noted that the first turn-on voltage is the voltage drop across the first lighting unit 340 when the driving current Id flows through the first lighting unit 340, and the second turn-on voltage is the voltage drop across the second lighting unit 350 when the driving current Id flows through the second lighting unit 350. In view of that, when the first lighting unit 340 of one lighting module 330 is functioning properly, the voltage drop across the second lighting unit 350 of the same lighting module 330 is the first turn-on voltage less than the second turn-on voltage, and therefore the second lighting unit 350 is idled at this time.

The first lighting unit 340 is capable of generating output light having a first brightness according to the driving current Id. The second lighting unit 350 is capable of generating output light having a second brightness according to the driving current Id. The second brightness is preferably identical to the first brightness. In the embodiment shown in FIG. 3, the first lighting unit 340 comprises a plurality of first LEDs 341 each with a first lighting operation voltage, and the second lighting unit 350 comprises a plurality of second LEDs 351 each with a second lighting operation voltage. The first LEDs 341 are electrically connected in series, and the second LEDs 351 are also electrically connected in series. The sum of the first lighting operation voltages of the first LEDs 341 is identical to the first turn-on voltage, and the sum of the second lighting operation voltages of the second LEDs 351 is identical to the second turn-on voltage. When the driving current Id flows through the first LEDs 341 of one first lighting unit 340, the brightness of combination output light generated by the first LEDs 341 is identical to the first brightness. When the driving current Id flows through the second LEDs 351 of one second lighting unit 350, the brightness of combination output light generated by the second LEDs 351 is identical to the second brightness.

In the operation of the lighting system 300, if the first lighting units 340 of the lighting modules 330 are all functioning properly, the conduction path of the lighting apparatus 320 is formed by the first lighting units 340. That is, the driving current Id is flowing through all the first lighting units 340 for providing desired output light, and the second lighting units 350 of the lighting modules 330 in the lighting apparatus 320 are all idled. If the first lighting unit 340 of the lighting module LY_1 is broken off, the conduction path of the lighting apparatus 320 is formed by the second lighting unit 350 of the lighting module LY_1 and the first lighting units 340 of other lighting modules 330, and therefore the driving current Id flows through the second lighting unit 350 of the lighting module LY_1 and the first lighting units 340 of other lighting modules 330. Alternatively, if the first lighting unit 340 of the lighting module LY_N is broken off, the conduction path of the lighting apparatus 320 is formed by the second lighting unit 350 of the lighting module LY_N and the first lighting units 340 of other lighting modules 330, and therefore the driving current Id flows through the second lighting unit 350 of the lighting module LY_N and the first lighting units 340 of other lighting modules 330. Besides, if the second brightness is substantially identical to the first brightness, the lighting apparatus 320 is capable of providing output light having the same brightness regardless of which conduction path is formed therein. In summary, the lighting system 300 is able to perform a lighting operation with high reliability.

Figure 4:
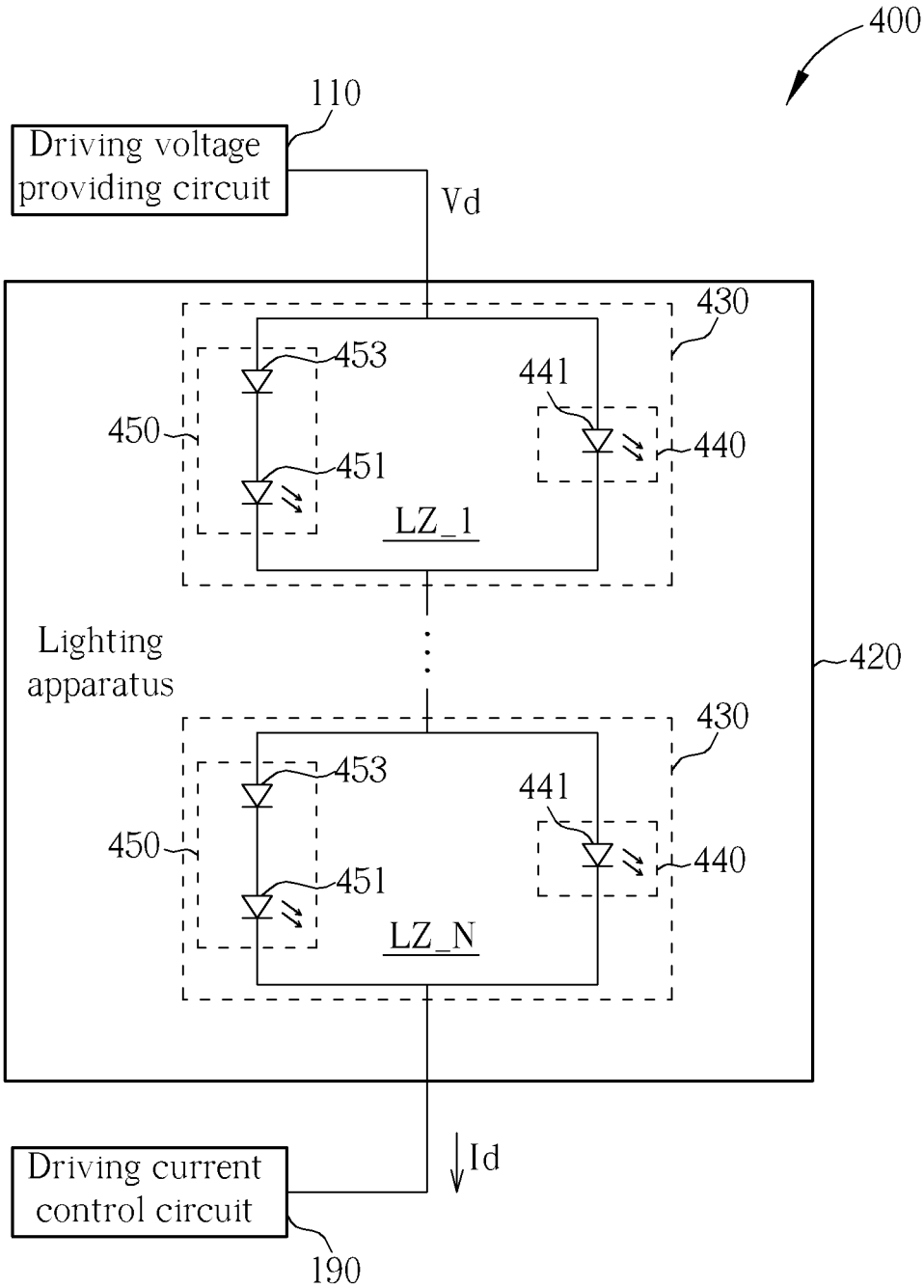
FIG. 4 is a schematic diagram showing a lighting system in accordance with a fourth embodiment.

FIG. 4 is a schematic diagram showing a lighting system in accordance with a fourth embodiment. As shown in FIG. 4, the lighting system 400 comprises the driving voltage providing circuit 110, the driving current control circuit 190, and a lighting apparatus 420 electrically connected between the driving voltage providing circuit 110 and the driving current control circuit 190. The lighting apparatus 420 includes a plurality of lighting modules 430 electrically connected in series. Each of the lighting modules 430 comprises a first lighting unit 440 with a first turn-on voltage and a second lighting unit 450 with a second turn-on voltage greater than the first turn-on voltage. The second lighting unit 450 is electrically connected in parallel with the first lighting unit 440. The sum of the second turn-on voltages of the second lighting units 450 in the lighting apparatus 420 is less than the driving voltage Vd. In one embodiment, the first lighting unit 440 and the second lighting unit 450 of each lighting module 430 are both disposed in one and the same chip. In another embodiment, the lighting modules 430 of the lighting apparatus 420 are all disposed in one and the same chip. It is noted that the first turn-on voltage is the voltage drop across the first lighting unit 440 when the driving current Id flows through the first lighting unit 440, and the second turn-on voltage is the voltage drop across the second lighting unit 450 when the driving current Id flows through the second lighting unit 450. In view of that, when the first lighting unit 440 of one lighting module 430 is functioning properly, the voltage drop across the second lighting unit 450 of the same lighting module 430 is the first turn-on voltage less than the second turn-on voltage, and therefore the second lighting unit 450 is idled at this time.

The first lighting unit 440 is capable of generating output light having a first brightness according to the driving current Id. The second lighting unit 450 is capable of generating output light having a second brightness according to the driving current Id. The second brightness is preferably identical to the first brightness. In the embodiment shown in FIG. 4, the first lighting unit 440 comprises a first LED 441 with a first lighting operation voltage, and the second lighting unit 450 comprises a second LED 451 with a second lighting operation voltage and a diode 453 with a forward operation voltage. The diode 453 is electrically connected in series with the second LED 451. The forward operation voltage may be identical to or different from the second lighting operation voltage. The second lighting operation voltage may be identical to or different from the first lighting operation voltage. The first lighting operation voltage is identical to the first turn-on voltage, and the sum of the second lighting operation voltage and the forward operation voltage is identical to the second turn-on voltage. When the driving current Id flows through the first LED 441 of one first lighting unit 440, the first LED 441 generates output light having the first brightness. When the driving current Id flows through the second LED 451 and the diode 453 of one second lighting unit 450, the second LED 451 generates output light having the second brightness.

In the operation of the lighting system 400, if the first lighting units 440 of the lighting modules 430 are all functioning properly, the conduction path of the lighting apparatus 420 is formed by the first lighting units 440. That is, the driving current Id is flowing through all the first lighting units 440 for providing desired output light, and the second lighting units 450 of the lighting modules 430 in the lighting apparatus 420 are all idled. If the first lighting unit 440 of the lighting module LZ_1 is broken off, the conduction path of the lighting apparatus 420 is formed by the second lighting unit 450 of the lighting module LZ_1 and the first lighting units 440 of other lighting modules 430, and therefore the driving current Id flows through the second lighting unit 450 of the lighting module LZ_1 and the first lighting units 440 of other lighting modules 430. Alternatively, if the first lighting unit 440 of the lighting module LZ_N is broken off, the conduction path of the lighting apparatus 420 is formed by the second lighting unit 450 of the lighting module LZ_N and the first lighting units 440 of other lighting modules 430, and therefore the driving current Id flows through the second lighting unit 450 of the lighting module LZ_N and the first lighting units 440 of other lighting modules 430. Besides, if the second brightness is substantially identical to the first brightness, the lighting apparatus 420 is capable of providing output light having the same brightness regardless of which conduction path is formed therein. In summary, the lighting system 400 is able to perform a lighting operation with high reliability.

Figure 5:
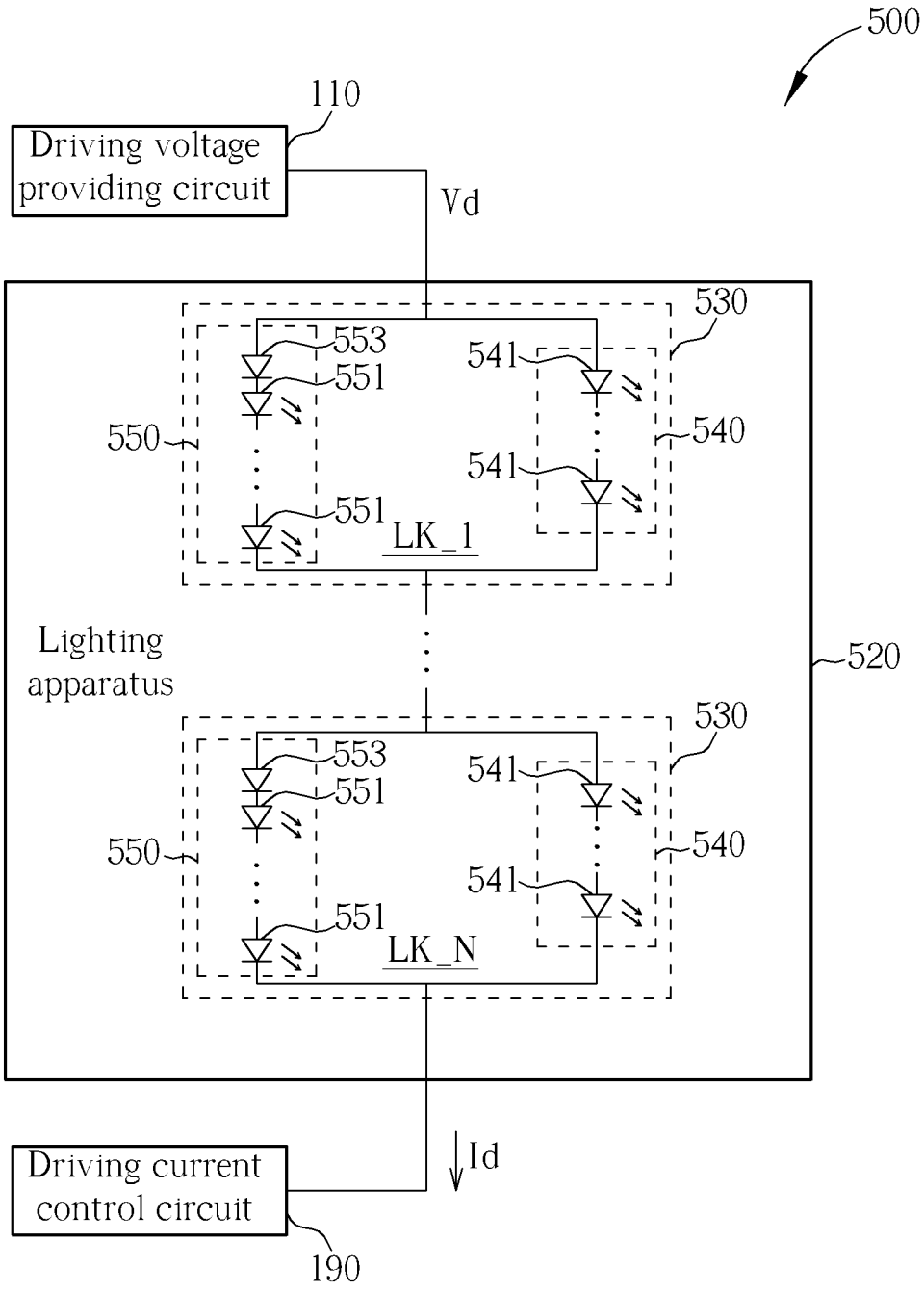
FIG. 5 is a schematic diagram showing a lighting system in accordance with a fifth embodiment.

FIG. 5 is a schematic diagram showing a lighting system in accordance with a fifth embodiment. As shown in FIG. 5, the lighting system 500 comprises the driving voltage providing circuit 110, the driving current control circuit 190, and a lighting apparatus 520 electrically connected between the driving voltage providing circuit 110 and the driving current control circuit 190. The lighting apparatus 520 includes a plurality of lighting modules 530 electrically connected in series. Each of the lighting modules 530 comprises a first lighting unit 540 with a first turn-on voltage and a second lighting unit 550 with a second turn-on voltage greater than the first turn-on voltage. The second lighting unit 550 is electrically connected in parallel with the first lighting unit 540. The sum of the second turn-on voltages of the second lighting units 550 in the lighting apparatus 520 is less than the driving voltage Vd. In one embodiment, the first lighting unit 540 and the second lighting unit 550 of each lighting module 530 are both disposed in one and the same chip. In another embodiment, the lighting modules 530 of the lighting apparatus 520 are all disposed in one and the same chip. It is noted that the first turn-on voltage is the voltage drop across the first lighting unit 540 when the driving current Id flows through the first lighting unit 540, and the second turn-on voltage is the voltage drop across the second lighting unit 550 when the driving current Id flows through the second lighting unit 550. In view of that, when the first lighting unit 540 of one lighting module 530 is functioning properly, the voltage drop across the second lighting unit 550 of the same lighting module 530 is the first turn-on voltage less than the second turn-on voltage, and therefore the second lighting unit 550 is idled at this time.

The first lighting unit 540 is capable of generating output light having a first brightness according to the driving current Id. The second lighting unit 550 is capable of generating output light having a second brightness according to the driving current Id. The second brightness is preferably identical to the first brightness. In the embodiment shown in FIG. 5, the first lighting unit 540 comprises a plurality of first LEDs 541 each with a first lighting operation voltage, and the second lighting unit 550 comprises a plurality of second LEDs 551 each with a second lighting operation voltage. The first LEDs 541 are electrically connected in series, and the second LEDs 551 are also electrically connected in series. The second lighting unit 550 further comprises a diode 553 with a forward operation voltage. The diode 553 is electrically connected in series with the second LEDs 551. The forward operation voltage may be identical to or different from the second lighting operation voltage. The second lighting operation voltage may be identical to or different from the first lighting operation voltage. The sum of the first lighting operation voltages of the first LEDs 541 is identical to the first turn-on voltage, and the sum of the forward operation voltage and the second lighting operation voltages of the second LEDs 551 is identical to the second turn-on voltage. When the driving current Id flows through the first LEDs 541 of one first lighting unit 540, the brightness of combination output light generated by the first LEDs 541 is identical to the first brightness. When the driving current Id flows through the second LEDs 551 and the diode 553 of one second lighting unit 550, the brightness of combination output light generated by the second LEDs 551 is identical to the second brightness.

In the operation of the lighting system 500, if the first lighting units 540 of the lighting modules 530 are all functioning properly, the conduction path of the lighting apparatus 520 is formed by the first lighting units 540. That is, the driving current Id is flowing through all the first lighting units 540 for providing desired output light, and the second lighting units 550 of the lighting modules 530 in the lighting apparatus 520 are all idled. If the first lighting unit 540 of the lighting module LK_1 is broken off, the conduction path of the lighting apparatus 520 is formed by the second lighting unit 550 of the lighting module LK_1 and the first lighting units 540 of other lighting modules 530, and therefore the driving current Id flows through the second lighting unit 550 of the lighting module LK_1 and the first lighting units 540 of other lighting modules 530. Alternatively, if the first lighting unit 540 of the lighting module LK_N is broken off, the conduction path of the lighting apparatus 520 is formed by the second lighting unit 550 of the lighting module LK_N and the first lighting units 540 of other lighting modules 530, and therefore the driving current Id flows through the second lighting unit 550 of the lighting module LK_N and the first lighting units 540 of other lighting modules 530. Besides, if the second brightness is substantially identical to the first brightness, the lighting apparatus 520 is capable of providing output light having the same brightness regardless of which conduction path is formed therein. In summary, the lighting system 500 is able to perform a lighting operation with high reliability.

To sum up, in the lighting operation of aforementioned lighting apparatuses/lighting systems according to the present invention, if the first lighting unit of one lighting module is broken off due to a burned-out event, the driving current is diverted to flow through the second lighting unit of the same lighting module so as to continue performing the lighting operation, thereby achieving high operation reliability.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. A lighting apparatus, comprising:

a first lighting unit with a first turn-on voltage, for generating output light having a first brightness according to a driving current; and a second lighting unit with a second turn-on voltage greater than the first turn-on voltage, electrically connected in parallel with the first lighting unit, for generating output light having a second brightness according to the driving current;

wherein:

the first lighting unit is consisted of a first LED (light emitting diode) with a first lighting operation voltage;

the second lighting unit is consisted of a second LED with a second lighting operation voltage; and the second lighting operation voltage of the second LED is greater than the first lighting operation voltage of the first LED.

2. The lighting apparatus of claim 1, wherein the second brightness is substantially identical to the first brightness.

3. The lighting apparatus of claim 1, wherein the first lighting unit and the second lighting unit are disposed in a same chip.

4. A lighting apparatus comprising:

a first lighting unit with a first turn-on voltage, for generating output light having a first brightness according to a driving current; and a second lighting unit with a second turn-on voltage greater than the first turn-on voltage, electrically connected in parallel with the first lighting unit, for generating output light having a second brightness according to the driving current;

wherein:

the first lighting unit is consisted of a first LED (light emitting diode) with a first lighting operation voltage;

the second lighting unit is consisted of a second LED with a second lighting operation voltage and a third LED with a third lighting operation voltage which are electrically connected in series; and a sum of the second lighting operation voltage and the third lighting operation voltage is greater than the first lighting operation voltage.

5. A lighting system, comprising:

a driving voltage providing circuit for providing a driving voltage;

a first lighting unit with a first turn-on voltage, electrically connected to the driving voltage providing circuit for receiving the driving voltage, for generating output light having a first brightness according to the driving current;

a second lighting unit with a second turn-on voltage greater than the first turn-on voltage, electrically connected in parallel with the first lighting unit and electrically connected to the driving voltage providing circuit for receiving the driving voltage, for generating output light having a second brightness according to the driving current, wherein the second turn-on voltage is less than the driving voltage; and a driving current control circuit, electrically connected to the first lighting unit and the second lighting unit, for providing a control of the driving current flowing through the first lighting unit or the second lighting unit;

wherein:

the first lighting unit comprises a plurality of first LEDs (light emitting diodes) each with a first lighting operation voltage which are electrically connected in series; and the second lighting unit comprises a plurality of second LEDs each with a second lighting operation voltage which are electrically connected in series;

wherein a sum of second lighting operation voltages of the second LEDs is greater than a sum of first lighting operation voltages of the first LEDs.

6. The lighting system of claim 5, wherein the second lighting unit further comprises:

a diode with a forward operation voltage, electrically connected in series with the second LEDs;

wherein a sum of the forward operation voltage and second lighting operation voltages of the second LEDs is greater than a sum of first lighting operation voltages of the first LEDs.

7. The lighting system of claim 5, wherein the first lighting unit and the second lighting unit are disposed in a same chip.

8. The lighting system of claim 5, wherein the second lighting unit is consisted of the plurality of second LEDs.

* * * * *